US008292676B2

(12) United States Patent
Schmidt et al.

(10) Patent No.: US 8,292,676 B2
(45) Date of Patent: Oct. 23, 2012

(54) SYSTEM CONNECTOR WITH ADAPTER MODULE

(75) Inventors: Martin Schmidt, Luebbecke (DE); Dieter Riepe, Luebbecke (DE); Harald Moeller, Luebbecke (DE); Sebastian Griepenstroh, Rahden (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 13/063,576

(22) PCT Filed: Dec. 9, 2009

(86) PCT No.: PCT/EP2009/008779

§ 371 (c)(1),
(2), (4) Date: Mar. 11, 2011

(87) PCT Pub. No.: WO2011/069521

PCT Pub. Date: Jun. 16, 2011

(65) Prior Publication Data

US 2011/0217880 A1 Sep. 8, 2011

(51) Int. Cl.
*H01R 13/502* (2006.01)

(52) U.S. Cl. ..... 439/701

(58) Field of Classification Search ..... 439/701, 439/638, 655, 650

See application file for complete search history.

(56) References Cited

U.S. PATENT DOCUMENTS

| | | | | |
|---|---|---|---|---|
| 4,639,061 | A * | 1/1987 | Muzslay | 439/587 |
| 5,137,462 | A * | 8/1992 | Casey et al. | 439/74 |
| 7,094,109 | B2 * | 8/2006 | Chou | 439/651 |
| 2002/0151202 | A1 | 10/2002 | Tachi et al. | |
| 2003/0040224 | A1 | 2/2003 | Fujii et al. | |
| 2003/0194914 | A1 | 10/2003 | Duck et al. | |
| 2007/0155252 | A1 | 7/2007 | Ferderer | |

FOREIGN PATENT DOCUMENTS

| | | | |
|---|---|---|---|
| DE | 30-42-293 | A1 * | 5/1985 |
| DE | 295 08 095 | | 7/1995 |
| DE | 296 01 998 | | 4/1996 |
| DE | 202 05 787 | | 7/2002 |
| DE | 20 2005 020 026 | | 3/2006 |
| EP | 0749178 | | 2/1995 |
| EP | 0860906 | | 8/1998 |
| EP | 2009747 | | 12/2008 |
| JP | 2009 054472 | | 3/2009 |

* cited by examiner

*Primary Examiner* — Phuong Dinh

(74) *Attorney, Agent, or Firm* — Jacobson Holman PLLC

(57) ABSTRACT

A system connector includes a first housing half, and a second housing half matching the first housing half. The two housing halves are snappable and lockable to each other via a locking device, and there is at least one contact module arranged in each of the housing halves. The contact module includes socket-like and/or pin-like electrical contact elements. An adapter module that is mountable on the contact module has a first connection side and a second connection side, each of which includes cylindrical adapter elements arranged in a row, in which socket contacts or pin contacts are arranged. The adapter module on its first connection side is connectable to one of the contact modules arranged within one of the housing halves. The socket contacts or pin contacts of the adapter element of the second connection side are suitable for electrical contacting of the contact modules of the matching housing halves.

18 Claims, 7 Drawing Sheets

SYSTEM CONNECTOR WITH ADAPTER MODULE

CROSS-REFERENCE TO RELATED APPLICATION

This is a national stage of PCT/EP09/008779 filed Dec. 9, 2009 and published in German, hereby incorporated by reference.

BACKGROUND OF THE INVENTION

1. Field of Invention

The invention concerns a system connector consisting of a first housing half and a second housing half matching it, the two halves being snappable and lockable to each other via a locking device and in which at least one contact module is arranged in both housing halves, which includes socket-like and/or pin-like electrical contact elements.

Connectors are required to connect or separate lines. The lines can be used to transport electrical current or also for other media (for example, for optical radiation, like light guide). Modular connectors are generally used in machine building and plant design to generate, evaluate or convey control signals directly to the unit being controlled within a connector. System connectors for evaluation of control signals can be equipped with additional electronic components, like switching relays or circuitry.

2. Description of the Prior Art

System connectors known to one skilled in the art, for example, from DE 202 05 787 U1 or EP 0 860 906 B1 are generally made from two housing halves. One housing half then is a cable outlet in which the corresponding housing half forms the connection area of the system connector. The individual housing halves can be equipped with so-called contact modules and thus individually adjusted to the corresponding use area. A housing half of EP 0 860 906 B1 has indentations to accommodate the individual contact modules into which the snap-in tabs of the contact modules can snap for their fastening in the housing half. The current direction within the system connector generally runs for safety reasons from the socket to the contact pin. The current-conducting side is therefore formed from the socket side. Wiring (socket or pins in the connection area) of the system connector is therefore dependent on current guiding in the use area. The individual contact modules of the system connector are laid out so that they have a socket and opposite pin contact side. If sockets are present in the connection area of a housing half, contact pins are found in the connection area of the other (matching) housing half. Ultimately the two housing halves of the connector are contacted to each other so that the opposite contact modules engage one in the other and thus produce an electrical contact with each other.

However, during use it was found in the connectors of the prior art that prewiring of connectors also entails certain drawbacks. Before assembly of such connectors a contact pin side and socket side must be established. Consequently, in the construction of a plant a supply of differently wired connectors must always be available.

SUMMARY OF THE INVENTION

The underlying task of the invention is to propose a system connector that can still be variably used even after equipping of the housing halves with said contact modules.

This task is solved by mounting an adapter module on the contact module, which has a first connection side and a second connection side, each of which includes cylindrical adapter elements arranged in a row in which socket contacts or pin contacts are arranged so that the adapter module at its first connection side can be connected to at least one contact module arranged within one of the housing halves and that the socket contacts or pin contacts of the adapter element of the second connection side are suitable for electrical contacting of the contact modules of the matching housing half.

The system connector according to the invention includes two housing halves each of which are equipped with contact modules. The contact modules of one of the two housing halves are provided with adapter modules so that the opposite contact modules of the other housing half can be electrically contacted.

The adapter modules are designed so that the contact modules can have contact sockets on both sides. Such system connectors have the advantage that the current direction in the use area is no longer relevant.

In a particularly advantageous variant of the invention the adapter module includes snap-in arms with molded-on snap-in tabs that engage into notches of the contact module prescribed for this purpose for locking. The adapter modules are firmly connected to the contact modules on this account and do not fall out of the contact module when the two system connector housing halves are brought together.

The individual adapter modules have cylindrical adapter elements. Pin contacts are contained in the cylindrical adapter elements, if the contact elements of the contact modules of both housing halves are designed socket-like.

On the other hand, socket contacts are contained within the cylindrical adapter elements, if the contact elements are pin-like.

It is therefore advantageous to always configure the adapter elements opposite to the contact elements—socket and pin or pin and socket.

Therefore it is now completely irrelevant whether the contact modules have a socket and an opposite pin contact side a socket contact side on both sides or a pin contact side on both sides.

An appropriate adapter element is available for each variant.

An advantageous modification of the invention includes an adapter module that has a bridge element for electrical bridging of at least two adjacent socket or pin elements within a contact module. This means that at least two contacts of a module arranged in a row are electrically connected to each other. In some applications so-called bridging of individual contact elements is necessary. This can be accomplished particularly simply with the bridge element according to the invention for electrical bridging.

In order to make such bridging visible to the user, the adapter module advantageously includes a display for visualization of the at least two socket or pin elements bridged to each other.

The adapter module advantageously includes a flat element which extends in the connection direction of the adapter module on the contact module and which is arranged between two snap-in arms whose snap-in tabs point in the same direction. The flat element also has a connector-like extension. Bridging of the contact elements is also visible laterally on the individual contact modules through this connector-like extension.

For visualization of bridging in the connection area of the system connector the connector is provided with a color at its end surface orthogonal to the flat element. Through color marking and bridging the user (even after the system connector is already assembled) can see the bridged socket or pin elements in the connection area. Advantageous embodiments of the invention are described herein.

BRIEF DESCRIPTION OF THE DRAWINGS

A practical example of the invention is shown in the drawings and further explained below. in the drawings

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modification within the spirit and scope of the invention will become apparent to those skilled in the art from this detailed description.

Figure 1:
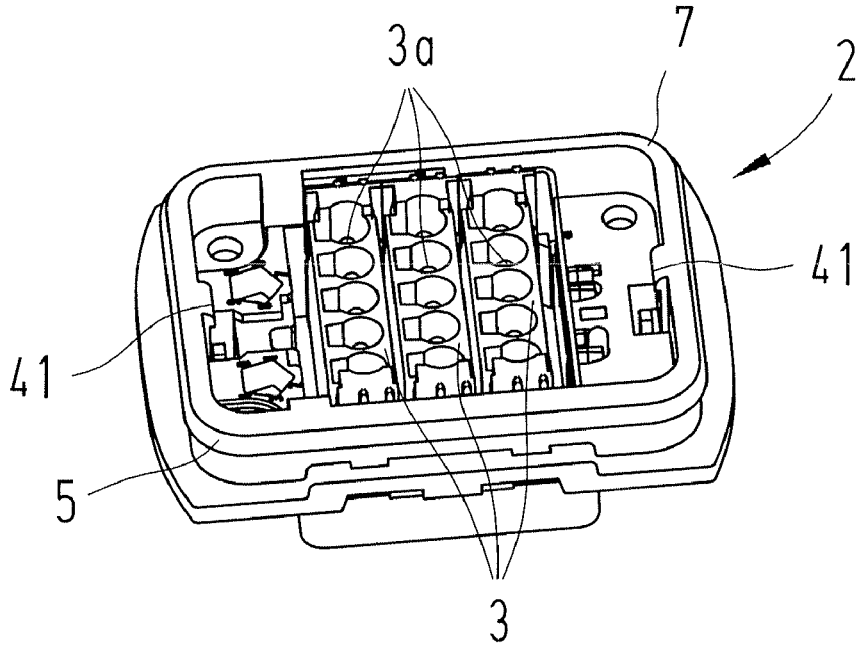
FIG. 1 shows a perspective view of the first housing half of a system connector.
Figure 2:
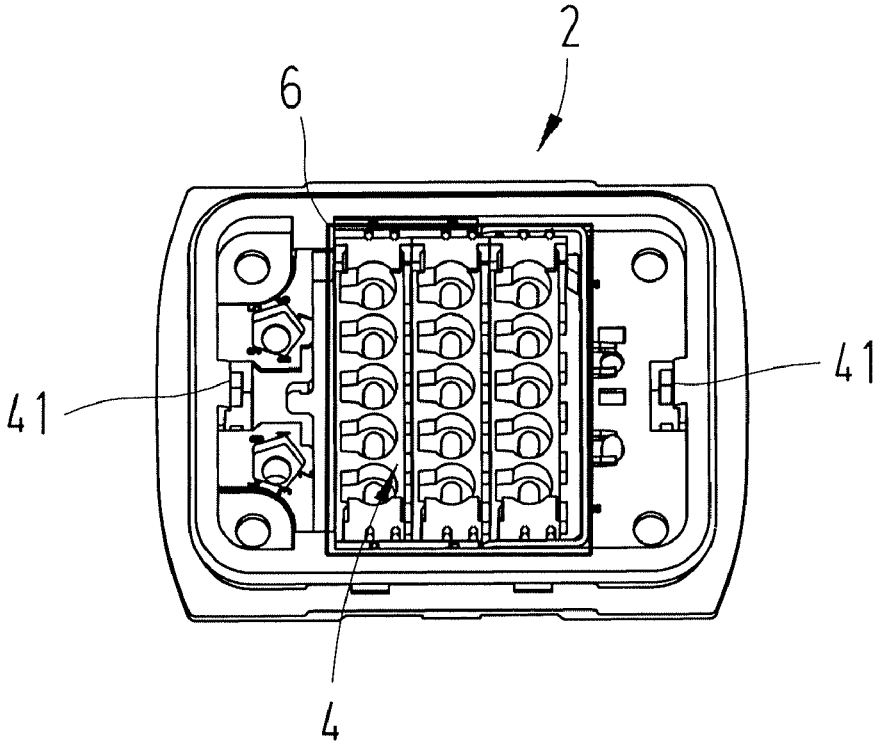
FIG. 2 shows a top view of the first housing half of a system connector.

FIGS. 1 and 2 show a first housing half 2 of a system connector 1. The first housing half 2 has an almost rectangular base surface in which an also rectangular recess 6 is made. Individual contact modules 3 that form a connection area 4 of the first housing half 2 can be inserted into this recess 6. In the second practical example shown here the contact modules 3 are inserted into the recess 6 for the housing half 2 on one of the narrow sides and are laterally pushed into a guide 31 (FIG. 4) along a rail (not shown) until the housing half is filled with contact modules 3. A guide 32 is provided for perpendicular introduction on contact module 3, which is guided on a matching (not shown) rail of recess 6. Similarly, a second housing half 10 can be equipped with contact modules 11.

The first housing half 2 has a protruding collar 7 in which a groove is made. A seal 5 is inserted into this groove, which seals the assembled finished housing 1 relative to environmental effects, like dust and moisture.

Figure 3:
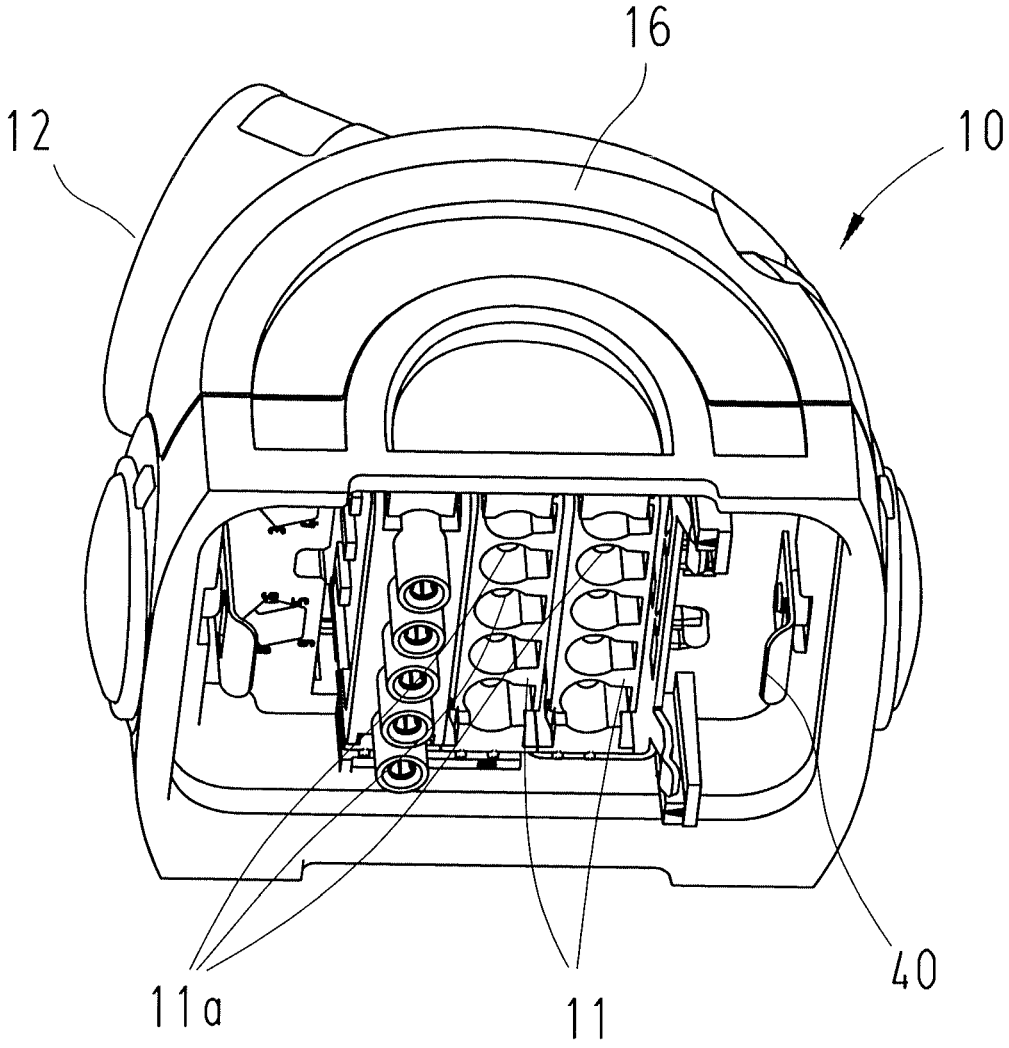
FIG. 3 shows a perspective view of a second housing half of a system connector.

FIG. 3 shows the second housing half 10 of the system connector 1. As already mentioned above, contact modules 11 can also be inserted into the second housing half 10. The second housing half is provided with a coupling housing 16 having a cable outlet 12.

Figure 4:
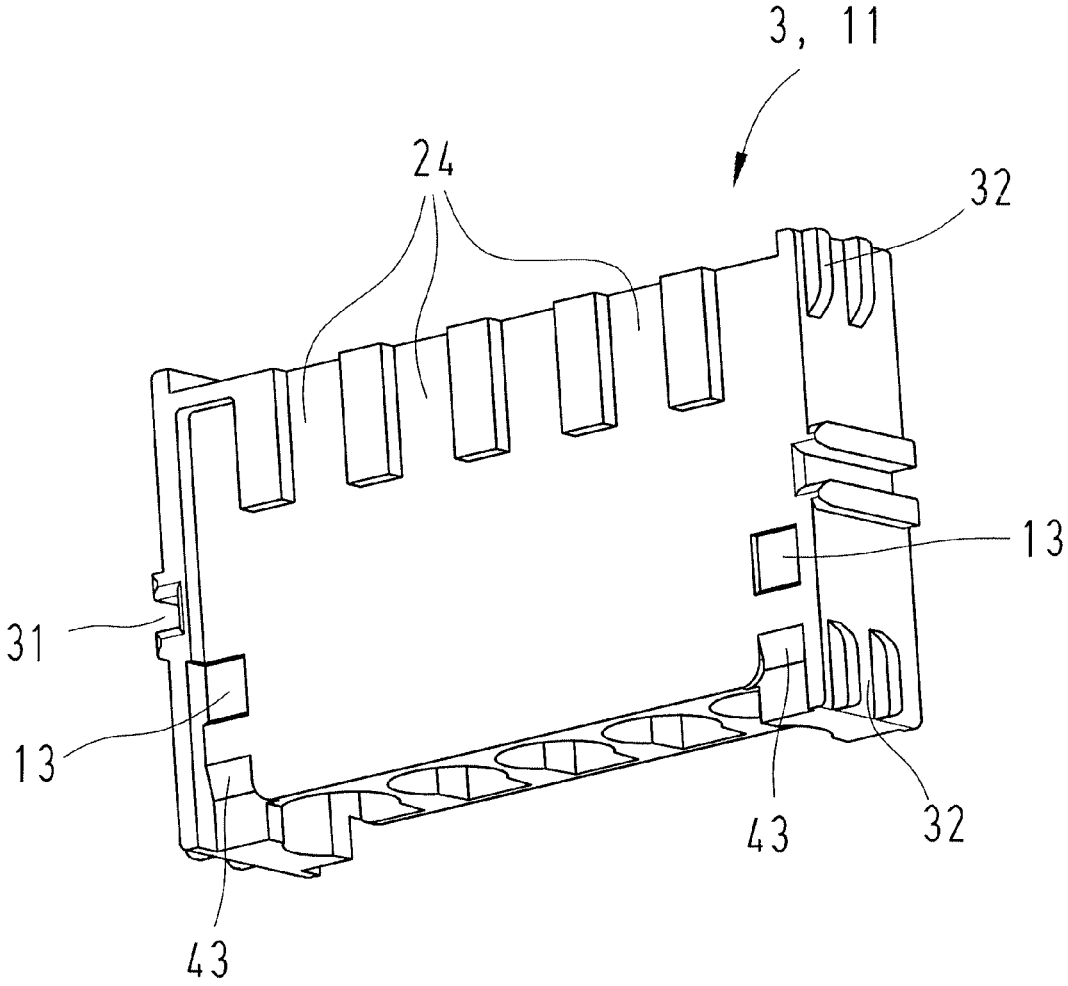
FIG. 4 shows a perspective view of a contact module for the housing halves of the system connector.

FIG. 4 shows the contact modules 3, 11 that can be inserted into both housing halves. The contact modules 3, 11 are designed almost cuboid. Individual socket-like contact elements 3*a*, 11*a* are arranged in contact modules 3, 11, which are suitable for producing electrical contact with electrical conductors. For this purpose a multiwire cable (not shown here) is guided into the cable outlet 12 of the second housing half 10 and the individual electrical conductors (in the connection area of the second housing half) are connected to the contact elements 11*a* of the contact module 11. For fastening of the cable it can be screwed to the cable outlet 12 by means of an appropriate screw connection.

In the variant of the system connector 1 shown here the contact modules 3, 11 of the housing halves 2, 10 are identical to each other in their connection areas 4, 4', i.e., aligned socket-like.

In order to produce electrical contact between the opposite contact modules 3, 11, an adapter module 20 is mounted on a contact module (for example, on a contact module 11 of the second housing half 10). The housing halves 2, 10 can then be snapped to each other.

Figure 5:
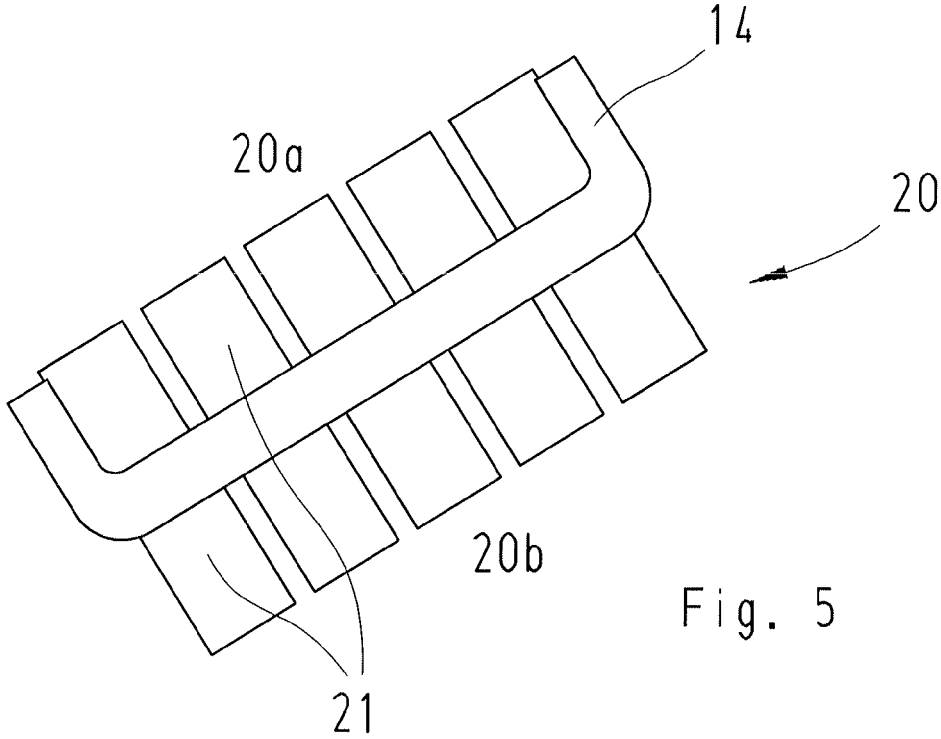
FIG. 5 shows a side view of an adapter module without bridge elements.
Figure 6:
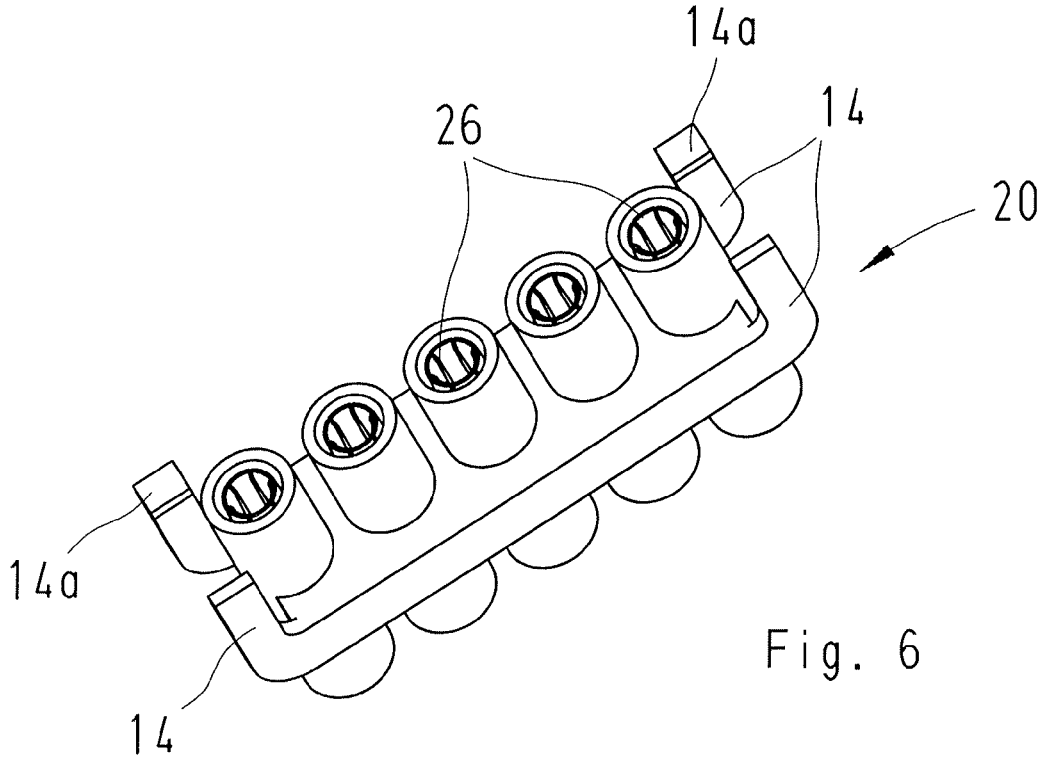
FIG. 6 shows a perspective view of the adapter module without bridge elements.
Figure 7:
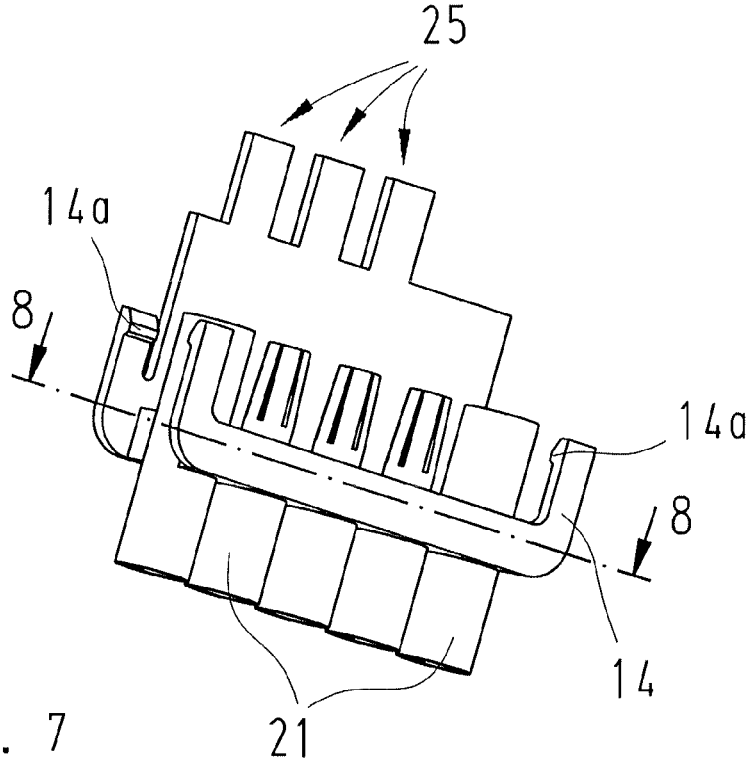
FIG. 7 shows a perspective view of the adapter module with integrated bridge elements.
Figure 8:
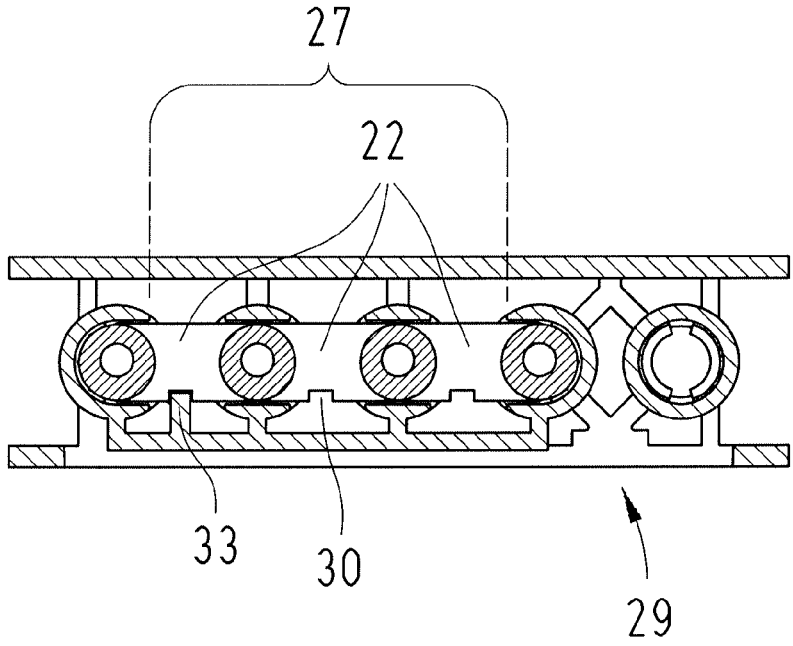
FIG. 8 shows a sectional view of the adapter module from FIG. 7.
Figure 9:
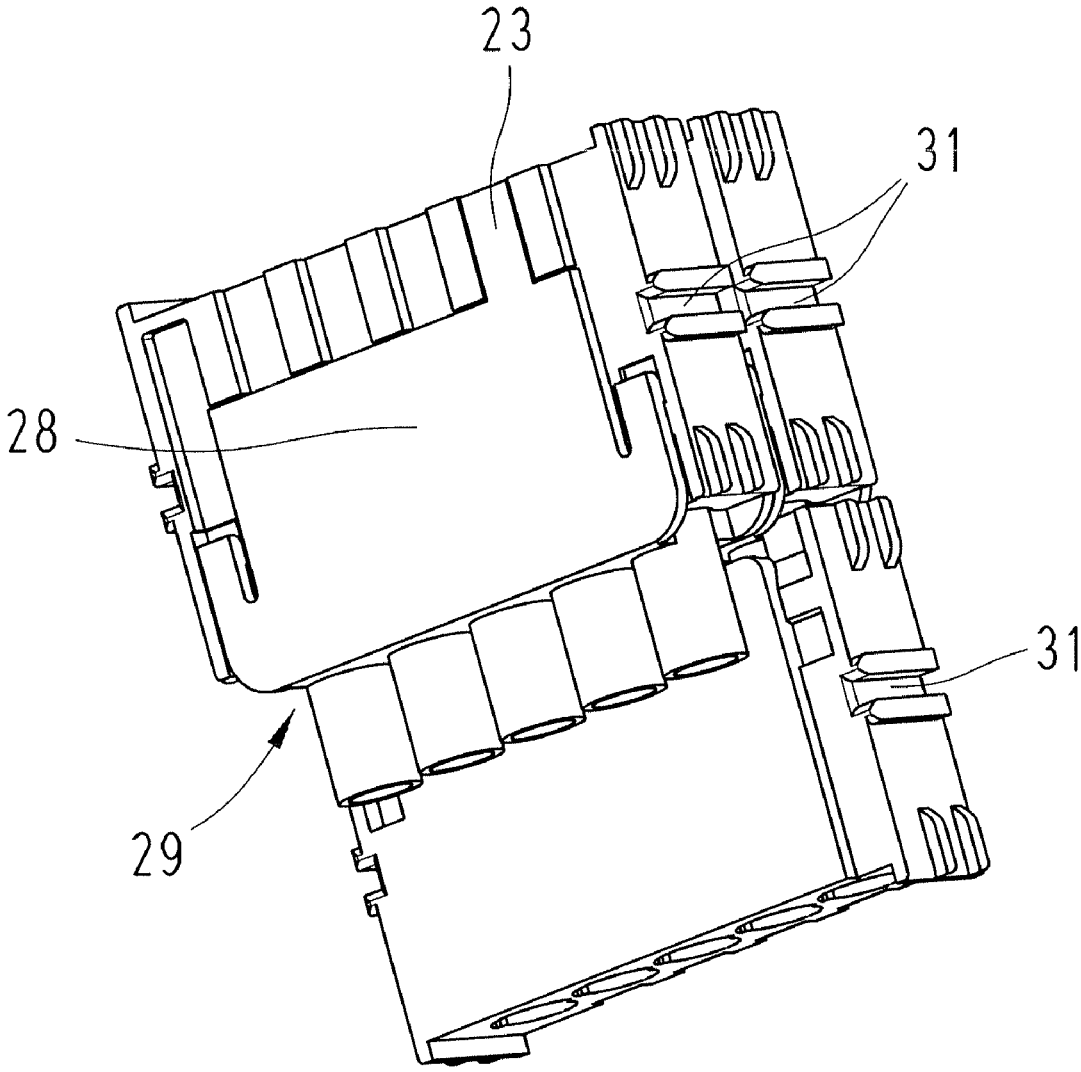
FIG. 9 shows a perspective view of an adapter module snapped onto the contact module with integrated bridge element and FIG. 10 shows a perspective view of the system connector.

As already explained above, an adapter module 20 is provided in order to produce electrical contact between the two identically aligned contact modules 3 and 11 of the housing halves 2, 10. As can be deduced from FIGS. 5 and 6, the adapter module 20 has a first connection side 20*a* and an opposite second connection side 20*b*. Several cylindrical adapter elements 21 arranged in a row are arranged on the adapter module 20 into which socket or pin contacts 26 are inserted, which again engage in the contact elements 3*a* and 11*a* in the contact modules 3, 11 and thus produce electrical contact between both 3 and 11. The individual socket and pin contacts 26 are produced by punching and bending, the socket contacts having slotted contact tabs in the connection direction. The contact tabs are bent radially inward on their outer end. In order to connect the adapter modules 20 to the contact modules 3, 11, snap-in hooks 14 with snap-in tabs 14*a* are applied to the adapter module 20. The contact modules 3, 11 have notches 13 on the connection side (in the connection direction) into which the snap-in tabs 14*a* of the adapter module engage during connection. FIGS. 7 and 8 show a modification of the adapter module 20. The adapter module 29 has a flat element 28 between the snap-in hooks 14 and in the connection direction to the contact modules 3, 11, which (after locking of the adapter module 29 with the contact module 3, 11) lies laterally on the contact module 3, 11 (FIG. 9). The flat element 28 includes connectors 23 as an extension whose significance is explained further below.

The contact modules 3, 11 are also provided with guides 43. The adapter module 20, 29 can be pushed onto the contact module 3, 11 along the guide. The guides 43 are only present on one side so that the adapter modules 29 can also only be mounted on one side. Polarization of the adapter module 29 is achieved on this account. In some technical applications it can be useful to electrically bridge individual contact elements 3*a*, 11*a* of the contact module 3, 11 to each other within the connector housing.

In this case a recess 27 is made in the area of the adapter elements 21 into which electrically conducting bridge elements 22 are introduced (FIG. 8). The bridge elements are plates having pin contacts connected to each other in conducting fashion. Moldings 33 are present within the recess 27 that engage in protrusions 30 of the bridge element 22. The entire component (plate and pin contacts) is introduced in one piece into the corresponding recess 27. Owing to the fact that the recesses 27 are only present on one side on the bridge element, the bridge element can also only be introduced on one side into the recess 27. Polarization of the bridge element 22 is thus achieved.

During engagement of the adapter element 21 of the adapter module 29 in contact elements 3*a*, 11*a*, these are then also bridged to each other.

In order to make the bridged contact elements 3*a*, 11*a* of modules 3, 11 visible, connectors 23, which can be inserted into guides 24 of the contact modules 3, 11 provided for this purpose, are molded on the flat element 28 of the adapter module 29. In a perspective side view of the contact module 29 (FIG. 9) the connector 23 indicates the position of bridging. The number of connectors 23 is equivalent to the number of bridge elements 22. In FIG. 9 the contact elements 3*a*, 11*a* of the contact module 3, 11, which are situated to the left and right of connector 23, are bridged to each other. In the adapter module 29 in FIG. 7 four adjacent contact elements 3*a*, 11*a* are bridged during mounting on a contact module 3, 11.

FIG. 7 shows a perspective view of the adapter module 29. The connectors 23 are marked in color on their end 25 facing the viewer so that bridging of individual contact elements 3*a* is made visible on viewing the connection area 8 of the system connector 1. In an advantageous variant of the adapter module 29 fluorescent or phosphorescent ingredients are added to the color. This enables the viewer to also recognize the contact elements 3*a* through a bridge to each other even under poor light conditions.

Figure 10:
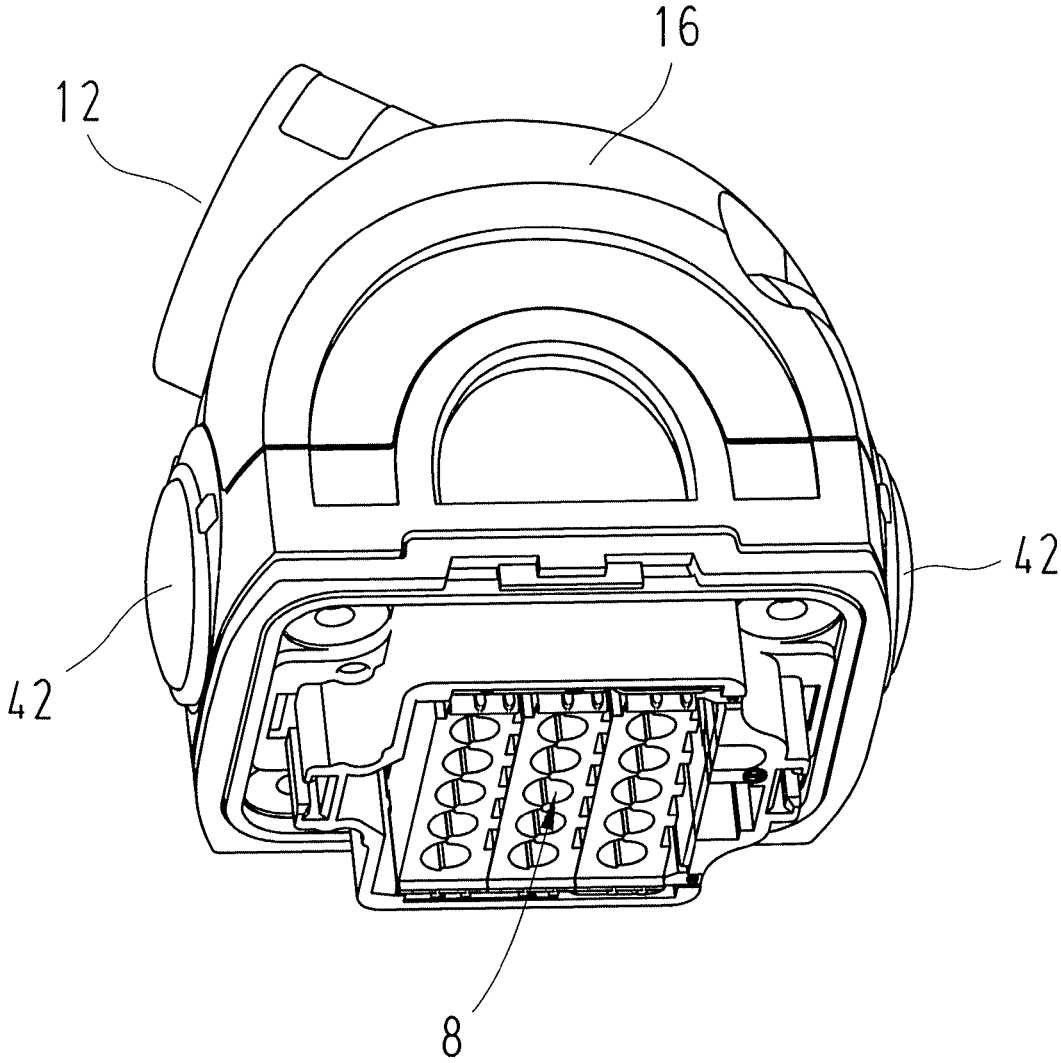

FIG. 10 shows a complete system connector 1. The system connector 1 includes a stamping mechanism (FIGS. 1, 2 and 3). During assembly of the housing halves 2, 10 a spring 40 snaps into a snap-in hook 41. Because of this the housing halves 2, 10 are locked to each other. By operating pushbutton 42 the snap-in springs 40 are guided from the effect area of the snap-in hook 41 and the upper housing half 10 can be removed from the lower housing half 2.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List Of Reference Numbers

System Connector with Adapter Module

1 System connector
2 First housing half
3 Contact module, 3*a* Contact elements
4 Connection face of the first housing half, 4' Connection face of the second housing half
5 Seal
6 Rectangular recess
7 Collar
8 Connection area
10 Second housing half
11 Contact module, 11*a* Contact elements
12 Cable outlet
13 Notches
14 Snap-in hooks, 14*a* Snap-in tabs
15
16 Coupling housing
20 Adapter module, 20*a* First side, 20*b* Second side
21 Adapter elements
22 Bridge elements
23 Connectors
24 Guide
25 End surface of connectors (colored)
26 Socket or pin contacts
27 Recess
28 Flat element
29 Modification of adapter module 20—adapter module with bridge element
30 Recesses
31 Guide
32 Guide
33 Molding
40 Spring
41 Snap-in hook
42 Operating buttons or pushbuttons

What is claimed is:

1. A system connector comprising:

a first housing half and a second housing half matching the first housing half, the two housing halves being snappable and lockable to each other via a locking device;

at least one contact module arranged in each of the housing halves, the at least one contact module including at least one of socket-like and pin-like electrical contact elements, and locking notches; and an adapter module that is mountable on the contact modules, the adapter module having a first connection side and a second connection side, each of which includes cylindrical adapter elements arranged in a row in which socket contacts or pin contacts are arranged, the adapter module being connectable on the first connection side to at least one of the contact modules arranged within one of the housing halves, the socket contacts or pin contacts of the adapter element of the second connection side being configured for electrical contacting of the contact modules of the matching housing halves, and the adapter module having snap-in arms with snap-in tabs, which engage the locking notches of the contact module, so as to lock the adapter module thereto.

2. The system connector according to claim 1, wherein the adapter module includes adapter elements with contacts therein, the contacts in the adapter elements being pin-like and the contact elements of the contact modules of both housing halves being socket-like.

3. The system connector according to claim 1, wherein the adapter module includes adapter elements with contacts therein, the contacts in the adapter elements being socket-like and the contact elements of the contact modules of both housing halves being pin-like.

4. The system connector according to claim 1, wherein the adapter module includes a bridge element for electrical bridging of at least two adjacent socket elements or pin elements within the contact module.

5. The system connector according to claim 4, wherein the adapter module includes a display for visualization of at least two socket elements or pin elements bridged to each other.

6. The system connector according to claimed 1, wherein the snap-in tabs of the snap-in arms point in a same direction, and wherein the adapter module includes a flat element, which extends in a connection direction of the adapter module to the contact module, and which is arranged between the two snap-in arms and snap-in tabs.

7. The system connector according to claim 6, further comprising, for visualization of bridged socket or pin elements, at least one connector which represents an extension of the flat element, the connector including a color marking on an end surface thereof that is orthogonal to the flat element.

8. The system connector according to claim 7, wherein the color marking contains fluorescent or phosphorescent ingredients.

9. The system connector according to claim 4, wherein the bridge element is polarized.

10. The system connector according to claim 7, wherein the flat element includes a plurality of the connectors that are extensions thereof, the connectors each including a color marking on an end surface thereof that is orthogonal to a surface of the flat element.

11. A system connector comprising:

a first housing half and a second housing half corresponding to the first housing half, the two housing halves being snappable and lockable to each other via a locking device;

at least one contact module arranged in each of the housing halves, the contact module including at least one of socket-like and pin-like electrical contact elements; and an adapter module that is connectable to the contact module, the adapter module having a first connection side and a second connection side, each of which includes cylindrical adapter elements arranged in a row in which socket contacts or pin contacts are arranged, the adapter module being connectable on the first connection side to at least one of the contact modules arranged within one of the housing halves, the socket contacts or pin contacts of the adapter element of the second connection side being configured for electrical contacting of the contact modules of the corresponding housing halves, and the adapter module including at least two snap-in arms having snap-in tabs aligned in a same direction, and a flat element which (i) extends in a connection direction of the adapter module to the contact module and (ii) is arranged between the two snap-in arms and snap-in tabs.

12. The system connector according to claim 11, wherein the contact module includes locking notches configured to engage the snap-in tabs of the adapter module.

13. The system connector according to claim 11, wherein the adapter module includes a polarized bridge element for electrical bridging of at least two of the socket-like or pin-like electrical contact elements that are adjacent within the contact module.

14. The system connector according to claim 13, wherein, for visualization of the bridged socket-like or pin-like electrical contact elements, the flat element includes a plurality of connectors that are extensions thereof, the connectors each including a color marking on an end surface thereof that is orthogonal to a surface of the flat element.

15. The system connector according to claim 11, wherein the adapter module includes adapter elements with contacts therein, the contacts in the adapter elements being pin-like and the contact elements of the contact modules of both housing halves being socket-like.

16. The system connector according to claim 11, wherein the adapter module includes adapter elements with contacts therein, the contacts in the adapter elements being socket-like and the contact elements of the contact modules of both housing halves being pin-like.

17. The system connector according to claim 13, wherein the adapter module includes a display for visualization of at least two socket elements or pin elements bridged to each other.

18. The system connector according to claim 14, wherein the color marking contains fluorescent or phosphorescent ingredients.

* * * * *